United States Patent [19]

Hall, Jr.

[11] Patent Number: 4,734,011

[45] Date of Patent: Mar. 29, 1988

[54] PULSATION DAMPENER FOR RECIPROCATING PUMPS

[75] Inventor: Russell W. Hall, Jr., Houston, Tex.

[73] Assignee: Texaco Inc., White Plains, N.Y.

[21] Appl. No.: 892,544

[22] Filed: Aug. 1, 1986

[51] Int. Cl.[4] ..... F04B 11/00

[52] U.S. Cl. ..... 417/2; 417/540

[58] Field of Search ..... 417/540, 542, 543, 2; 138/31

[56] References Cited

U.S. PATENT DOCUMENTS 2,811,931 11/1957 Everett ..... 417/540 X
2,951,450 9/1960 Fisher ..... 417/542 X
4,430,049 2/1984 Aiba ..... 417/540

FOREIGN PATENT DOCUMENTS 954598 9/1982 U.S.S.R. ..... 417/542

*Primary Examiner*—Leonard E. Smith
*Attorney, Agent, or Firm*—Robert A. Kulason; James J. O'Loughlin; Ronald G. Gillespie

[57] ABSTRACT

A pumping system includes a pump having a plurality of cylinders, a suction manifold and a discharge manifold. Each cylinder includes a piston connected to a pump shaft. The system also includes apparatus for rotating the pump shaft so as to move the pistons. A fluid enters the pump by way of the suction manifold, is compressed in the pump by the pistons and the compressed fluid leaves the pump by way of the discharge manifold. Equipment connected to the discharge manifold affects the discharging of the compressed fluid in accordance with the number of cylinders and the rotational frquency of the pump shaft.

8 Claims, 8 Drawing Figures

PULSATION DAMPENER FOR RECIPROCATING PUMPS

BACKGROUND OF THE INVENTION

1. Field of the Invention

The present invention relates to pumps in general and, more particularly, to pumps used in compressing a fluid.

2. Description of the Prior Art

Multicylinder single acting positive displacement pumps are used to move drilling fluid, water, crude oil, refined petroleum products, etc. Often the output pressure of such a pump will be 1,000 psi or greater. Further the discharge from this type of pump is a variable function of time. It consists of a constant flow, corresponding to the time averaged flow rate, and an oscillating or "alternating current" component. This oscillating flow accounts for the pressure surges observed in the output of these pumps. These pressure pulsations can be of sufficient magnitude to cause severe vibration in the output manifold of the pump. This vibration can be so severe as to cause premature fatigue failures of output piping, resulting in loss of pumped product and/or damage to facilities and personnel.

These pressure pulsations in the pump discharge may be reduced by incorporating a "pulsation dampener" in the discharge manifold. Conventionally such pulsation dampeners consist of a properly sized compliant volume which may or may not be followed by a "choke tube", i.e. a restricted length of pipe leading to the discharge manifold. The purpose of the compliant volume is to provide a surge tank with which the oscillating component of the pump output can interact to produce pressure pulsations that are much smaller than those which result from the interaction of the oscillating output with the unmodified pump discharge manifold.

One common form of a compliant volume pulsation dampener is a nitrogen filled volume separated from the pumped fluid by a flexible bladder or diaphragm. These range in size from one to twenty gallons.

When properly "charged" with nitrogen under pressure, and tuned, these devices can significantly reduce the severity of one or two of the lower frequency pulsations generated by the pump. Unfortunately, if pump speed or discharge pressure is changed, the dampener must be retuned if it is to continue to be effective.

Although the gas-filled dampener is thought of as a frequency insensitive surge tank, measurements indicate that this type of dampener is a highly resonant system, offering significant attenuation over only a very narrow frequency range.

Unfortunately, these gas-charged units are not usually well maintained. Unrepaired, ruptured bladders and improper charge pressures are common. Under these conditions, the dampeners perform poorly.

A second, and far more effective form of compliant volume consists of a large tank completely filled with the pumped fluid. The compliance of such a device depends on the compressibility of the fluid and the size of the enclosed volume. To be effective, these devices must be one or two feet in diameter and ten to twenty feet tall, with capacities up to two hundred gallons. When combined with a choke tube ten to fifteen feet long, these devices make a most effective pulsation dampener.

The totally liquid filled dampener is a large, heavy installation. To withstand discharge pressures in excess of one thousand pounds per square inch, tank wall thicknesses on the order of three to five inches are necessary. Thus, these dampeners may weigh three to four tons each. In addition, the flow restriction through the choke tube will result in pressure losses on the order of thirty to fifty pounds per square inch.

The present invention provides effective dampening of two lower pulsation frequencies generated by a multicylinder single acting pump. These frequencies have been shown to be the primary cause of fatigue failures in discharge manifolds. The present invention provides effective dampening independent of pump speed, and does not require retuning if the pump speed changes.

SUMMARY OF THE INVENTION

A pumping system includes a pump having a plurality of cylinders, a suction manifold and a discharge manifold. Each cylinder includes a piston connected to a pump shaft. The system also includes apparatus for rotating the pump shaft so as to move the pistons. A fluid enters the pump by way of the suction manifold, is compressed in the pump by the pistons and the compressed fluid leaves the pump by way of the discharge manifold. Equipment connected to the discharge manifold affects the discharging of the compressed fluid in accordance with the number of cylinders and the rotational frequency of the pump shaft.

The objects and advantages of the invention will appear more fully hereinafter from a consideration of the detailed description which follows, taken together with the accompanying drawings wherein one embodiment of the invention is illustrated by way of example. It is to be expressly understood, however, that the drawings are for illustration purposes only and are not to be construed as defining the limits of the invention.

DESCRIPTION OF THE INVENTION

Figure 1:
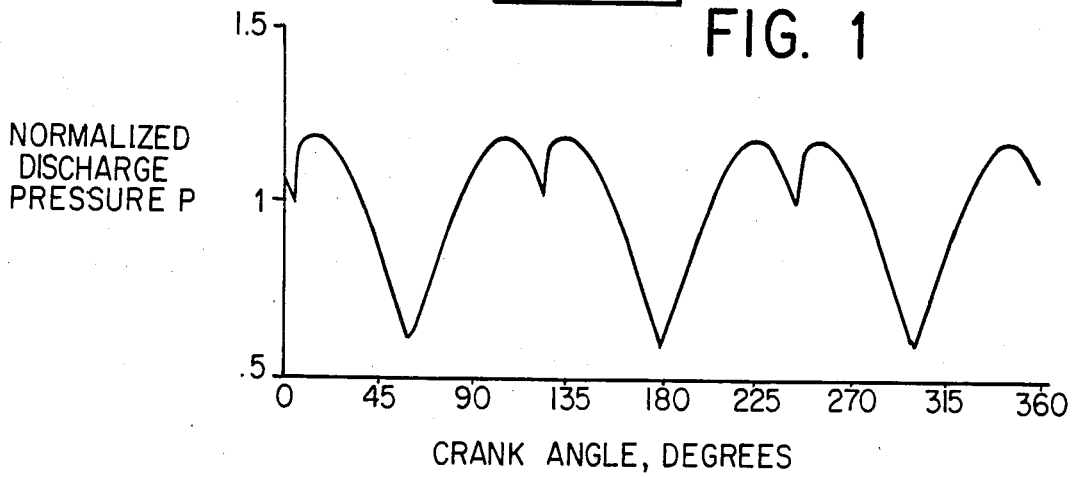
FIG. 1 is a plot of normalized discharged pressure versus crank angle (of the pump shaft) of a conventional pumping system.

Pressure pulsations in the discharge of a multicylinder, single acting, positive displacement pump are the result of variations in the flow rate caused by the almost sinusoidal motion of the pump pistons. The most commonly encountered reciprocating pumps have either three, five or seven cylinders, and are referred to as triplex, quintuplex, or septuplex. The discharge from these pumps is a superposition of the discharges of the individual cylinders. FIG. 1 shows a graph of normalized discharge pressure of a non-compensated triplex pump versus crankshaft angle. The pressure pulsations are excursions in pressure above and below the average discharge pressure, and these pressure excursions correspond to excursions in flow rate above and below the average discharge flow rate. The present invention reduces such variations in flow rate, and the resulting variations in discharge pressure, by cyclically altering the volume of the discharge manifold, for example, by means of two compensating pistons driven synchronously with the pump crankshaft.

The discharge pulsation of a multicylinder pump is a cyclic function of time. Its fundamental cycle length corresponds to one rotation of the pump shaft. Therefore, this cyclic function of time can be resolved into a series of sinusoidal components by means of Fourier analysis. Therefore, if P(t) is the pulsation pressure in the pump discharge as a function of time, $$P(t) = A(O)/2 + {}_{n=1} [A(n)*\cos(n*w*t) + B(n)*\sin(n*w*t)]$$

$n = 1, 2, 3, \ldots$ where $[A(n)^2+B(n)^2]^{\frac{1}{2}}$=amplitude of the pressure pulsation with frequency n*w, where w is the frequency of the pump crankshaft rotation. If all N cylinders of the pump are operating with equal efficiency, which is usually the case, then $$A(k)=B(k)=0 \text{ when k is not equal to } n*N$$

where N=number of pump cylinders usually N=3, 5, or 7 and $$P(t) = A(O)/2 + \sum_{n=1}^{\infty} [A(N*n)*\cos(N*n*w*t) + B(N*n)*\sin(N*n*w*t)]$$

Since viscous dampening eliminates pressure pulsations with frequencies above about 150 or 200 Hz, $$A(N*n)=B(N*n)=0 \text{ for } N*n \text{ larger than } 30$$

Therefore, the Fourier representation of the pump discharge pulsations can be written $$P(t) = A(O)/2 + \sum_{n=1}^{\frac{30}{N}} [A(N*n)*\cos(N*n*w*t) + B(N*n)*\sin(N*n*w*t)]$$

The first two terms, corresponding to n=1 and n=2 represent the pulsations with frequencies of N and 2*N times the shaft frequency. In the case of a triplex pump running at 300 RPM, these frequencies would be 15 and 30 Hz, respectively. These two lowest frequency pulsations are usually the largest and most destructive in the spectrum. They are responsible for most of the fatigue failures that occur in the discharge manifold and piping, since many of the mechanical systems associated with the pump installation have acoustic resonances in this frequency range. These resonances are readily excited by the two lowest frequency pulsations.

Figure 2:
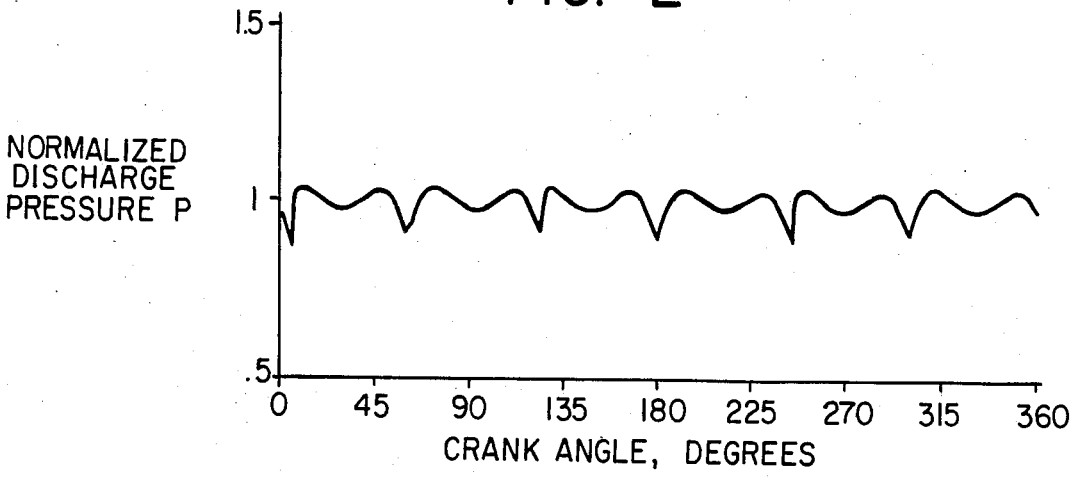
FIG. 2 is a plot of normalized discharged pressure versus crank angle (of the pump shaft) of the pumping system shown in FIG. 3.

By causing two properly sized plungers to intrude into the volume of the discharge manifold, and to oscillate sinusoidally with frequencies of N and 2*N times the shaft frequency of the pump, the two lowest frequency pulsations can be removed from the pulsation spectrum. This eliminates the problems associated with excitation of the mechanical resonances of the pipe and its supporting structure. The remaining pulsations are only a small fraction of the pulsations before removal of the two lowest frequency pulsations. FIG. 2 shows a graph of normalized discharge pressure of a triplex pump, modified in accordance with the present invention, versus crankshaft angle.

Figure 3:
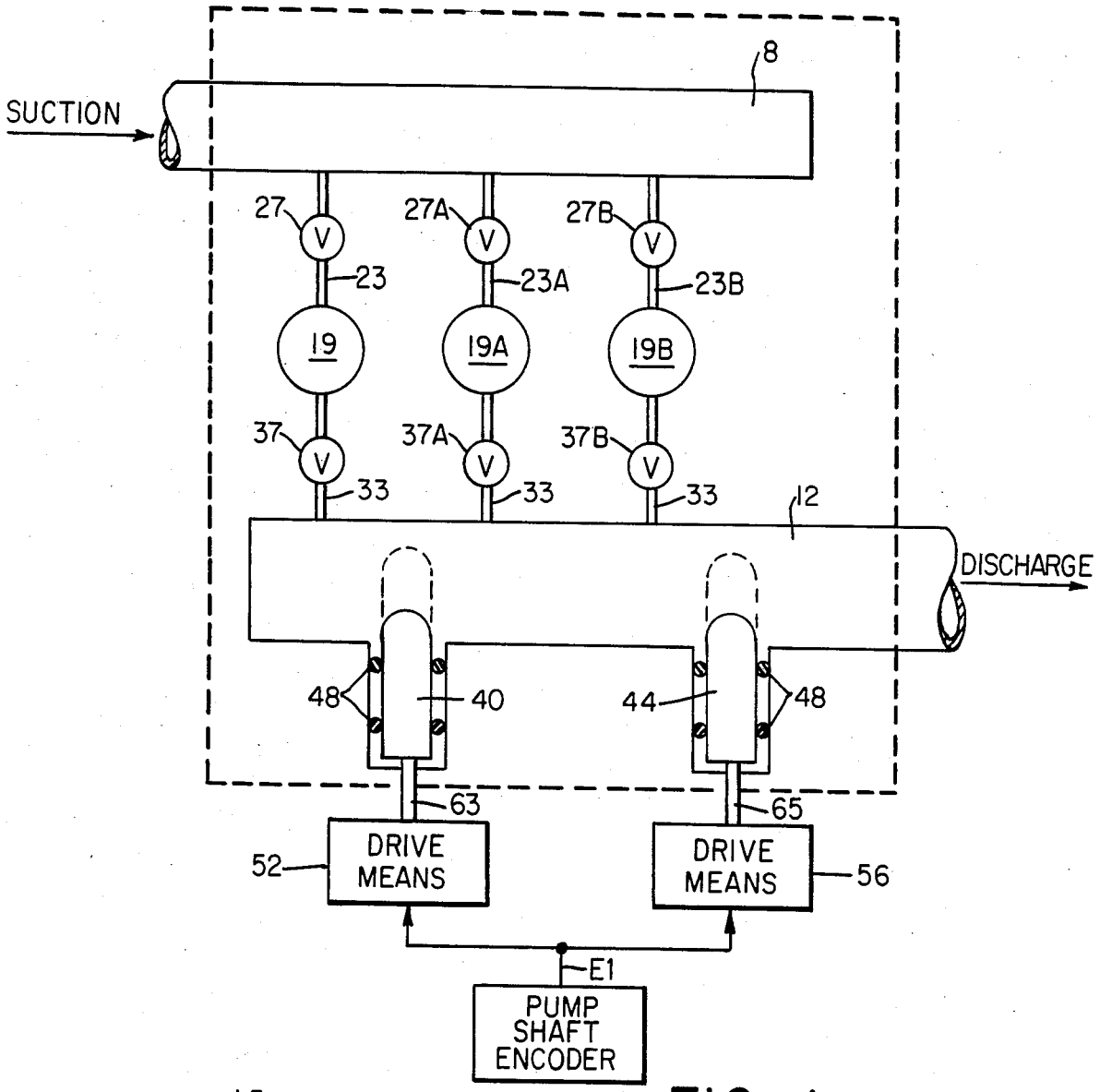
FIG. 3 is a diagram of a pumping system, for compressing a fluid, constructed in accordance with the present invention.

With reference to FIG. 3, there is shown a three cylinder single acting pump 3 having a suction manifold 8, a discharge manifold 12, and cylinders 19, 19A and 19B. All elements having the same numeric designation, but different alpha suffixes, are connected and operate in the same manner as those elements having the same numeric designation but without a suffix. Suction manifold 8 is connected to cylinders 19, 19A and 19B by way of lines 23, 23A and 23B, respectively, having check valves 27, 27A and 27B, respectively. The discharge of cylinders 19, 19A and 19B, is provided to discharge manifold 12 by way of lines 33, 33A and 33B, respectively which also have check valves 37, 37A and 37B, respectively.

Figure 4:
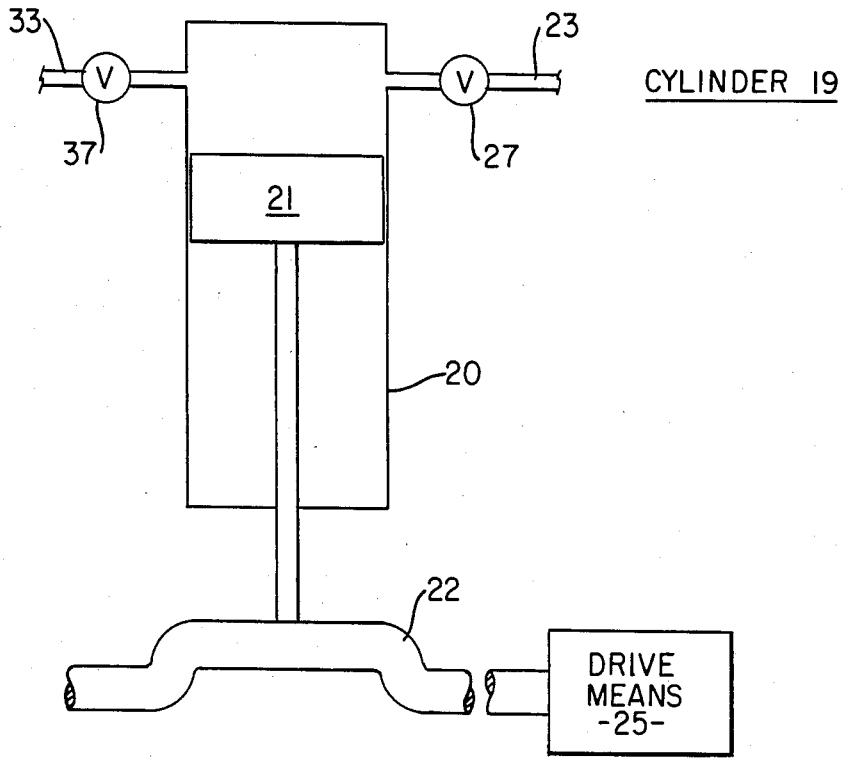
FIG. 4 is a schematic representation of a cylinder shown in FIG. 3.

FIG. 4 shows cylinder 19, which is typical of the cylinders of pump 3, having a housing 20, a piston 21 mechanically connected to a pump shaft 22 which is rotated by drive means 25. As pump shaft 22 rotates it drives piston 21 towards the top of housing 20 compressing the fluid between piston 21 and housing 20. The action of check valve 27 prevents the fluid from flowing from housing 20 through line 23 as the pressure of the fluid builds during compression. The pressure of the fluid upon reaching a predetermined value causes check valve 37 to open. The compressed fluid flows into line 33. On the return stroke of piston 21, check valve 37 closes and check valve 27 opens admitting more fluid to housing 20 to be compressed. All of the aforementioned elements of pump 3 are conventional and operate in the conventional manner. The present invention modifies discharge manifold 12 by having movable compensating pistons 40 and 44 arranged with discharge manifold 12 so they will enter into and change the volume of discharge manifold 12. Compensating pistons 40 and 44 have seals 48 to prevent leakage of the fluid being pumped. Pistons 40 and 44 are connected to drive means 52 and 56, respectively by connecting rods 63 and 65, respectively. Drive means 52 and 56 will be discussed in more detail hereinafter. Drive means 52 and 56 receive an electrical signal E1 from a pump shaft encoder 68. Pump shaft encoder 68 may be any kind of sensor for sensing the rotational speed of the drive shaft for pump 3. Encoder 68 may be a magnetic detector sensing the passage of a magnet attached to the shaft, or encoder 68 may be a mechanical device. How the shaft speed is sensed is of no import to an understanding of the present invention. Suffice to say that signal E1, or its equivalent, does reflect the rotational speed of the crankshaft.

Figure 5:
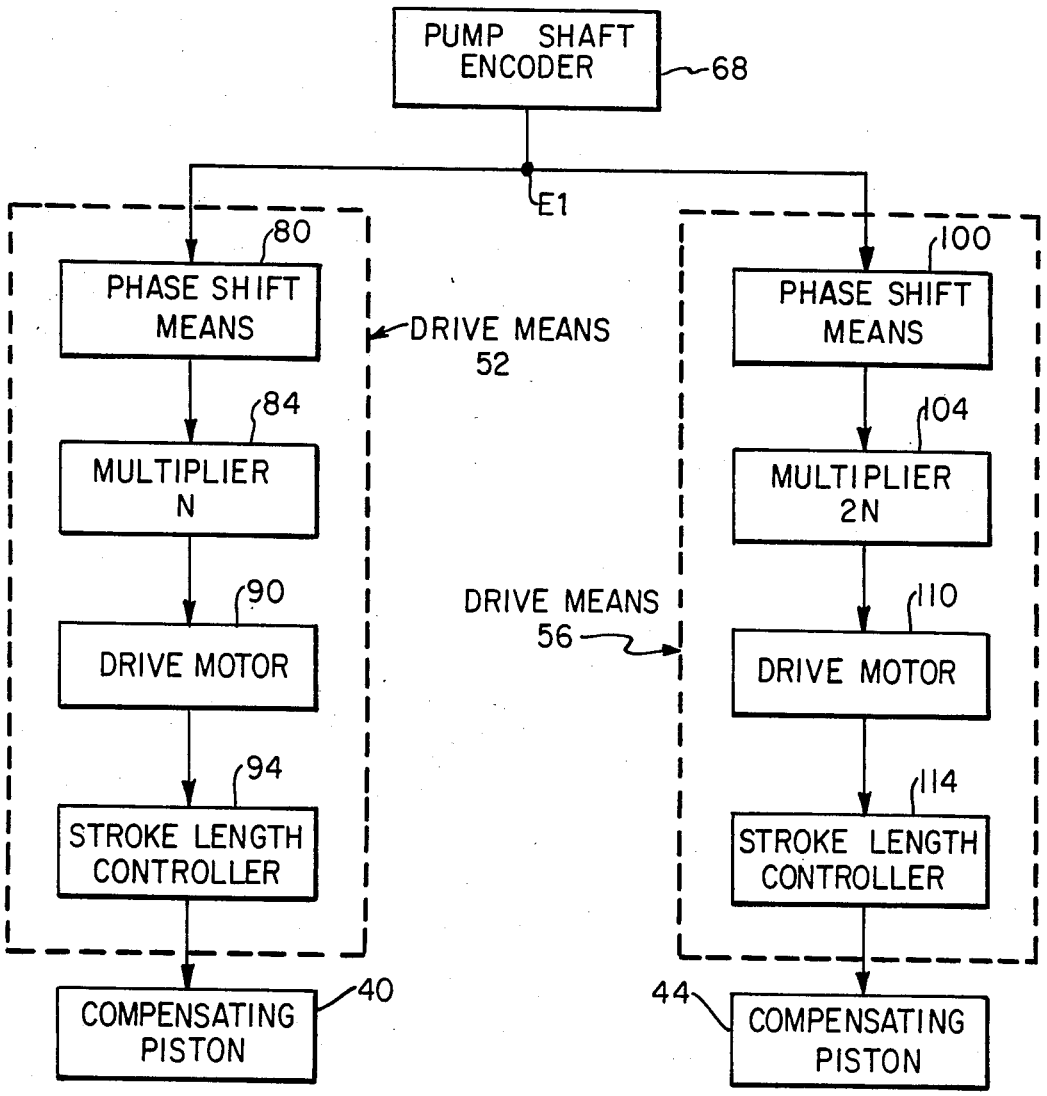
FIG. 5 is a simplified block diagram of the drive means shown in FIG. 3.

Referring to FIG. 5, pump shaft encoder 68 provides signal Ė1 to phase shift means 80 which in turn shifts the phase and provides it to a multiplier N 84. The multiplied signal is provided to a drive motor 90 which in turn controls the stroke length controller 94 connected to compensating piston 40.

Similarly, signal E1 is applied to phase shift means 100 which in turn is applied to a multiplier 2N 104. The multiplied signal is then applied to drive motor 110 which drives stroke length controller 114 to control compensating piston 44.

All of the foregoing may be done by electrical circuitry and so forth. However, it may also be done through mechanical means. For example, in FIGS. 6 and 7 the phase shift work may be done by utilizing an outer ring gear 120 having teeth on the inside surface and also on the outside surface. Ring gear 120 has an index mark 121 which is used in conjunction with a vernier scale 124. Located within ring gear 120 are planetary gears 127A, 127B and 127C, mechanically attached to a shaft 130. A sun gear 135 is in contact with planetary gears 127A, 127B and 127C which in turn is in contact with ring gear 120. Sun gear 135 is mechanically coupled to the pump shaft (not shown) by way of a rod 138. A worm gear 142 is enmeshed with the teeth of the outer surface of ring gear 120 and is held in place by mountings 144. A knob 148 is used to turn worm gear 142. The arrows shown in FIGS. 5 and 6 show the direction of rotation in relation of the gearing.

Figure 6:
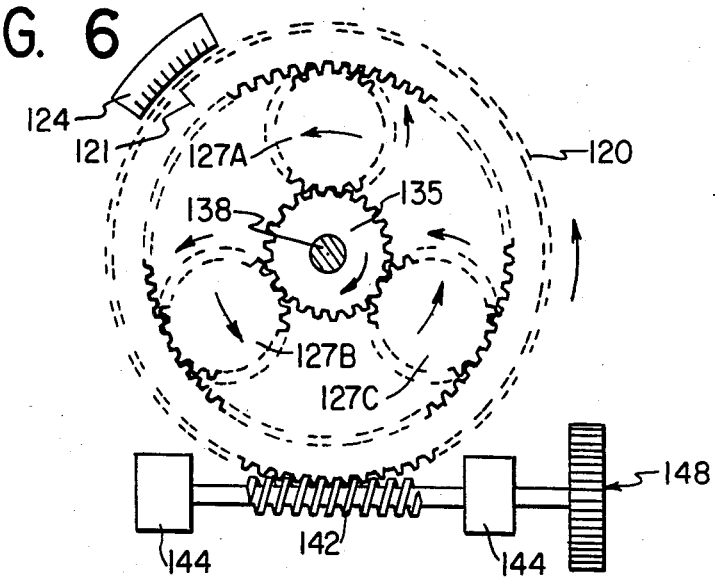
FIGS. 6 and 7 are representative drawings of the phase shift means shown in FIG. 5.
Figure 7:
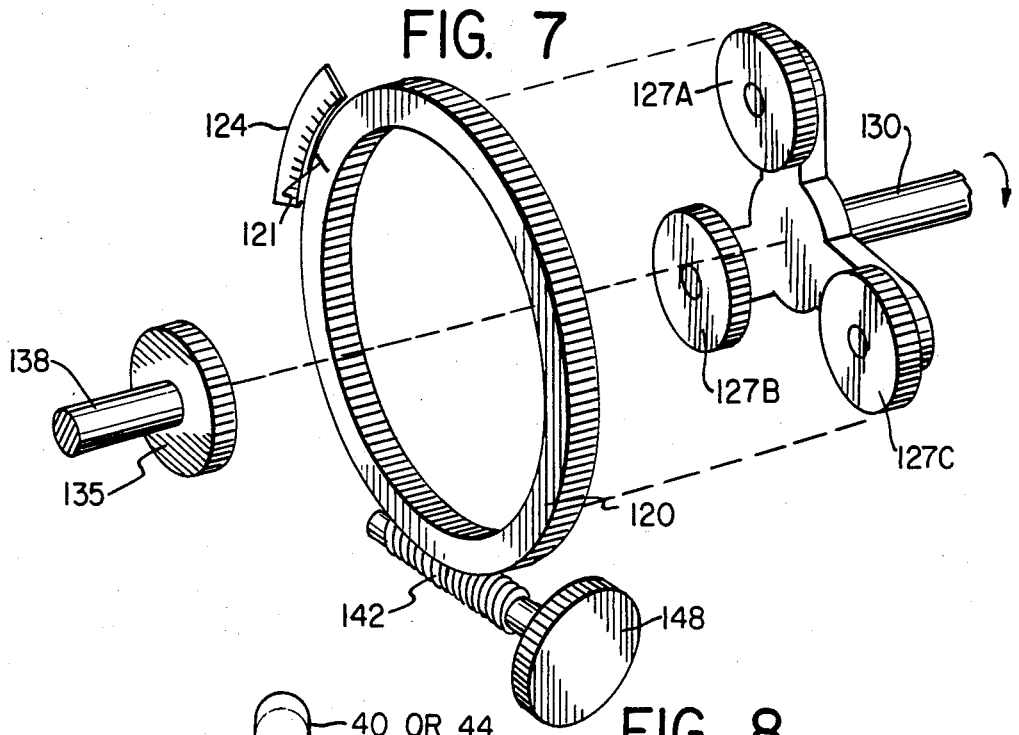

In operation, the phase shift of means 80 of FIGS. 6 and 7 is that the rotation of pump shaft 22 causes sun gear 135 to rotate in a clockwise direction which in turn causes planetary gears 127A, 127B and 127C to rotate in a counterclockwise direction. This motion imparts a rotation to shaft 130 in a clockwise direction. The phase shift occurs by operation of worm gear 142 to physically rotate ring gear 120, thus moving index mark 121 in one direction or in the other direction. The effect of the movement of ring gear 120 essentially is the phase shifting operation. As the pump shaft rotates there is a fixed relationship in the rotation between it and shaft 130. Thus, as pump shaft completes one cycle so will the shaft 130 and a mark on both pump shaft 22 and shaft 130 if in the same position, will have a fixed relationship to each other. However, as ring gear 120 is moved, then the mark on shaft gear 130 will either lead or lag the corresponding mark on pump shaft 22 as a function of the movement of ring gear 120.

Figure 8:
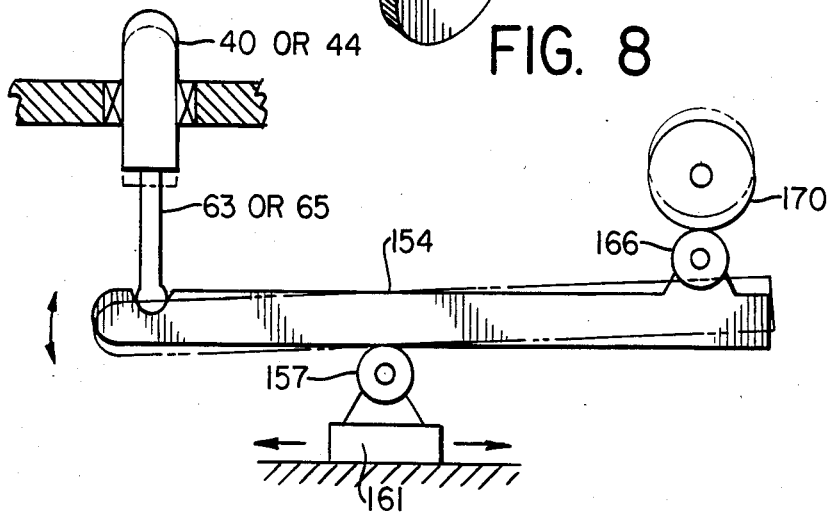
FIG. 8 is a representative drawing of the stroke length controller shown in FIG. 5.

One means to vary stroke lengths of pistons 40 or 44 is shown in FIG. 8.

In controlling the stroke length of compensating piston with connecting rods 63 or 65, connecting rods 63 or 65 are connected to an arm 154 which rests on a roller 157. Roller 157 is supported by a movable mounting block 161. Arm 154 has a roller 166 affixed to it which is in turn in contact with a cam 170.

In operation, cam 170 is driven by the drive motor 90 or 110. As cam 170 rotates, it causes arm 154 to move in a reciprocal manner thereby driving compensating piston 40 or 44 up and down into the manifold 12. To change the stroke length, mounting block 161 is moved in a desired direction, either closer to cam 170 or further away from cam 170. The dash lines in FIG. 8 represent a different position of arm 154 and compensating piston 40 or 44 and cam 170. It can be seen from the dash lines that the penetration of piston 40 or 44 into discharge manifold 12 has changed. The penetration into discharge manifold 12 has changed so that as shown there is less of compensating piston 40 or 44 entering discharge manifold 12. This temporarily increases the volume of discharge manifold 12 to compensate for temporary increase in flow rate above average flow.

A primary advantage of the present invention is that it is not frequency sensitive, and will continue to remove the two lowest frequency pulsations when pump speed is altered.

The drive for these two compensating pistons can be arranged in a number of ways, either mechanical or electrical.

Mechanically, the compensating pistons can be driven by cams on a shaft driven by either a toothed belt, chain or gear connecting to the crankshaft of the pump.

Electrically, the compensating pistons can be powered by electric motors synchronized to the motion of the pump crankshaft.

In either case, provision must be made to properly phase the motion of each of the two pistons to the motion of the #1 cylinder of the pump.

The present invention as hereinbefore described is a non-frequency sensitive pulsation dampener for a multi-cylinder single acting pump.

What is claimed is:

1. A pumping system comprising:

suction means for receiving a fluid, a plurality of cylinder means connected to the suction means for compressing the fluid, each cylinder means having a piston;

a pump shaft connected to the pistons in the plurality of cylinder means;

drive means for rotating the pump shaft so as to move the pistons in the plurality of cylinder means;

a discharge manifold connected to the plurality of cylinder means in a manner so as to discharge the compressed fluid from the plurality of cylinder means; and affecting means connected to the discharge manifold and to the pump shaft means for affecting the discharging of the compressed fluid in accordance with the number of cylinder means and the rotational frequency of the pump shaft, and wherein the affecting means includes:

two compensating pistons which enter the discharge manifold, and means for driving one compensating piston at a first fundamental frequency and the other compensating piston at a second harmonic frequency, both compensating piston frequencies being related to the number of cylinder means and to the rotational frequency of the pump shaft.

2. A system as described in claim 1 in which the affecting means includes:

means for sensing the rotational frequency of the pump shaft and providing a signal representative thereof, first phase shift means connected to the sensing means for phase shifting the signal provided by the sensing means, first multiplier means for multiplying the signal provided by the first phase shift means by the number of cylinders, means connected to the first multiplier means and to the one compensating piston for moving the one compensating piston in accordance with the signal from the first multiplier means, second phase shift means for shifting the phase of the signal from the sensing means and providing a signal, second multiplier means connected to the second phase shift means for multiplying the signal provided by the second phase shifting means by twice the number of cylinders, and means connected to the second multiplier means and to the other compensating piston for moving the other compensating piston in accordance with the signal from the second multiplier means.

3. A pumping system comprising:

suction means for receiving a fluid, a plurality of cylinder means connected to the suction means for compressing the fluid, each cylinder means having a piston;

a pump shaft connected to the pistons in the plurality of cylinder means;

drive means for rotating the pump shaft so as to move the pistons in the plurality of cylinder means, a discharge manifold connected to the plurality of cylinders in a manner so as to discharge the compressed fluid from the plurality of cylinder means; and removal means connected to the discharge means for removing the lowest frequencies of pulsation of the discharging compressed fluid regardless of the rotational speed of the pump shaft, and wherein the removal means includes:

two compensating pistons which enter the discharge manifold, and means for driving one compensating piston at a first frequency and the other compensating piston at a second frequency, both compensating piston frequencies being related to the number of cylinder means and to the rotational frequency of the pump shaft.

4. A system as described in claim 3 in which the removal means includes:

means for sensing the rotational frequency of the pump shaft and providing a signal representative thereof, first phase shift means connected to the sensing means for phase shifting the signal provided by the sensing means, first multiplier means for multiplying the signal provided by the first phase shift means by the number of cylinder means, means connected to the first multiplier means and to the one compensating piston for moving the one compensating piston in accordance with the signal from the first multiplier means, second phase shift means for shifting the phase of the signal from the sensing means and providing a signal, second multiplier means connected to the second phase shift means for multiplying the signal provided by the second phase shift means by twice the number of cylinder means, and means connected to the second multiplier means and to the other compensating piston for moving the other compensating piston in accordance with the signal from the second multiplier means.

5. A pumping method comprising the steps of:

receiving a fluid;

compressing the fluid with a plurality of cylinder means, each cylinder means having a piston;

rotating a pump shaft connected to the pistons so as to move the pistons in the plurality of cylinder means;

discharging the compressed fluid from the plurality of cylinder means through a discharge manifold; and affecting the discharging of the fluid in accordance with the number of cylinder means and the rotational frequency of the pump shaft, wherein the affecting step includes:

locating two compensating pistons in the discharge manifold, and driving one compensating piston at a first frequency and the other compensating piston at a second frequency, both compensating piston frequencies being related to the number of cylinder means and to the rotational frequency of the pump shaft.

6. A method as described in claim 5 in which the affecting step includes:

sensing the rotational frequency of the pump shaft, providing a signal representative thereof, phase shifting the signal provided by the sensing means to provide a first phase shift signal, multiplying the first phase shifted signal by the number of cylinder means to provide a first multiplied signal, moving the one compensating piston in accordance with the first multiplied signal, shifting the phase of the signal from the sensing means to provide a second phase shift signal, multiplying the second phase shifted signal by twice the number of cylinder means to provide a second multiplied signal, and moving the other compensating piston in accordance with the second multiplied signal.

7. A pumping method comprising:

receiving a fluid;

compressing the fluid with a plurality of cylinder means, each cylinder means having a piston;

rotating a pump shaft connected to the pistons so as to move the pistons in the plurality of cylinder means;

discharging the compressed fluid from the plurality of cylinders through a discharge manifold; and removing the lowest frequencies of pulsation of the discharging compressed fluid regardless of the rotational speed of the pump shaft, wherein the removal step includes:

locating two compensating pistons in the discharge manifold, and driving one compensating piston at a first frequency and the other compensating piston at a second frequency, both compensating piston frequencies being related to the number of cylinder means and to the rotational frequency of the pump shaft.

8. A method as described in claim 7 in which the affecting means includes:

sensing the rotational frequency of the pump shaft and providing a signal representative thereof, phase shifting the signal provided by the sensing means to provide a first phase shifted signal, multiplying the first phase shifted signal by the number of cylinder means to provide a first multiplied signal, moving the one compensating piston in accordance with the first multiplied signal, shifting the phase of the signal from the sensing means to provide a second phase shifted signal, multiplying the second phase shifted signal by twice the number of cylinder means to provide a second multiplied signal, and moving the other compensating piston in accordance with the second multiplied signal.

* * * * *